US006658132B1

(12) United States Patent
Moster et al.

(10) Patent No.: US 6,658,132 B1
(45) Date of Patent: Dec. 2, 2003

(54) WATERPROOF COVER FOR HOUSING IN HOSPITAL BED CONTAINING SPEAKER OR ELECTRONIC COMPONENTS

(75) Inventors: Jeffrey A. Moster, Cincinnati, OH (US); David W. Hensley, Milan, IN (US); Robert M. Zerhusen, Cincinnati, OH (US); Michael W. Hamilton, West Harrison, OH (US); David W. Hornbach, Brookville, IN (US); Olivier Barbu, Redon (FR)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/265,173

(22) Filed: Mar. 9, 1999

Related U.S. Application Data

(60) Provisional application No. 60/111,838, filed on Dec. 11, 1998.

(51) Int. Cl.[7] ..... H04R 25/00

(52) U.S. Cl. ..... 381/388; 381/386; 381/333; 381/189

(58) Field of Search ..... 381/374, 385, 381/386, 388, 395, 391, 189, 333; 379/439, 451, 452; 181/149

(56) References Cited

U.S. PATENT DOCUMENTS

| | | | | |
|---|---|---|---|---|
| 4,183,015 A | | 1/1980 | Drew et al. | |
| 4,680,790 A | * | 7/1987 | Packard et al. | 379/432 |
| 5,054,063 A | * | 10/1991 | Lo et al. | 379/439 |
| 5,083,334 A | | 1/1992 | Huck et al. | |
| 5,097,550 A | | 3/1992 | Marra, Jr. | |
| 5,129,117 A | | 7/1992 | Celestina et al. | |
| 5,175,897 A | | 1/1993 | Marra, Jr. | |
| 5,191,663 A | | 3/1993 | Holder et al. | |
| 5,255,965 A | | 10/1993 | Chen et al. | |
| 5,365,623 A | * | 11/1994 | Springer | 5/658 |
| 5,542,138 A | | 8/1996 | Williams et al. | 5/658 |
| 5,732,423 A | | 3/1998 | Weismiller et al. | |

FOREIGN PATENT DOCUMENTS

| | | |
|---|---|---|
| DE | 3240145 A1 | 5/1984 |
| EP | 0 780 111 A1 | 6/1997 |

* cited by examiner

*Primary Examiner*—Huyen Le
(74) *Attorney, Agent, or Firm*—Bose McKinney & Evans LLP

(57) ABSTRACT

A waterproof cover is coupled to a surface of a housing coupled to a bed. The cover is configured to seal an opening formed in the housing against water penetration. The cover is also configured so that the sound waves are audible through the cover.

60 Claims, 8 Drawing Sheets

WATERPROOF COVER FOR HOUSING IN HOSPITAL BED CONTAINING SPEAKER OR ELECTRONIC COMPONENTS

This application claims the benefit of U.S. provisional application Ser. No. 60/111,838 filed Dec. 11, 1998.

BACKGROUND AND SUMMARY OF THE INVENTION

This invention relates to covers for housings in hospital beds and more particularly to waterproof covers for housings in hospital beds containing speakers or other electronic components.

Many hospital beds include speakers and microphones to allow two-way communication between patient and caregiver. This two-way communication system allows the caregiver to communicate with the patient. The speaker is also used for television and radio sound, or other desired purpose. These speakers are often disposed in a housing which includes circuitry and switches for adjusting the hospital bed. These housings are often incorporated in siderails attached to the bed.

To maintain a substantially sterile caregiving environment, hospital beds are regularly cleaned with various cleaning solutions. In many countries, hospital beds are actually run through hospital bed washing devices similar to automatic car washes. Cleaning solutions have deleterious effects on speaker diaphragms and electronic connections to speakers as well as circuitry for adjusting the bed. Healthcare facilities will appreciate a waterproof speaker cover which would allow cleaning of hospital beds without concern for damaging speakers and other electronic components contained in the bed. The cover also keeps dirt, dust, and other particulates from entering the housing.

An apparatus for use on a hospital bed includes a housing having a surface with an opening therethrough communicating with its interior region, a speaker located in the interior region adjacent to the opening, and a waterproof cover attached to the surface of the housing, the cover being configured to seal the opening against water penetration through the opening and into the interior region of the housing. The waterproof cover is attached to the surface of the housing with an adhesive. The housing may include multiple openings with the waterproof cover sealing all of the openings against water penetration. The waterproof cover may be made from a polyester material and have a thickness of about 0.002 to about 0.007 inches. The waterproof cover may also include speaker location indicia located adjacent the openings in the surface of the housing. The housing surface may be formed to include a lip surrounding an outer perimeter edge of the cover.

The housing can include a switch access opening and a switch for controlling a system located in the interior region of the housing with the switches actuator surface positioned in the switch access opening and the waterproof cover being attached to surface of the housing to seal the switch access opening against water penetration. The switch may be an which is partially transmitted through a translucent area in the waterproof cover adjacent the switch. The system controlled by the switch can be a nurse call system, a bed articulation control, a bed hi/lo control, a room lighting control, music control, or a television control.

Typically a housing according to the present invention is coupled to a siderail of the hospital bed. Housings are often formed from a first shell portion and a second shell portion configured to be coupled to the first shell portion to define the housing formed from a molded plastic material. The housing includes a patient-facing side surface and a caregiver-facing side surface each formed to include an opening to facilitate passage of sound waves from the speaker therethrough and a first and a second waterproof cover attached to the patient-facing side surface and the caregiver-facing side surfaces, respectively, to seal the openings against water penetration into the interior region of the housing.

An apparatus for use on a hospital bed in accordance with the present invention includes a housing having an interior region, a first and a second opening in communication with the interior region, a switch actuatable through the first opening located in the interior adjacent to the first opening, a speaker in the interior of the housing adjacent to the second opening, and a waterproof cover attached to the exterior surface of the housing over the first and second openings to seal the first and second openings against water penetration into the interior region of the housing. A controller actuated by the switch may be contained in the housing for performing a specified function. The waterproof cover may contain indicia located adjacent to the first opening indicating the specified function actuated by the switch. The waterproof cover is typically attached to the exterior surface of the housing with an adhesive and has a thickness of about 0.002 to about 0.007 inches. The waterproof cover may also include speaker location indicia located adjacent the second opening in the housing. The housing exterior surface is typically formed to include a lip surrounding an outer perimeter edge of the cover. The housing is adapted for coupling to a siderail of the hospital bed. Housing may be formed from a first shell portion and a second shell portion coupled together to form the housing. The housing may include a patient-facing side surface and a caregiver-facing side surface each formed to include an opening to facilitate passage of sound waves from the speaker therethrough and first and second waterproof covers attached to both side surfaces to seal the openings against water penetration into the interior region of the housing.

Features and advantages of the invention will become apparent to those skilled in the art upon consideration of the following detailed description of an illustrated embodiment exemplifying the best mode of carrying out the invention as presently perceived.

DETAILED DESCRIPTION OF THE DRAWINGS

Patients in healthcare facilities typically spend much of their time in hospital beds which must be adjusted to provide comfort and facilitate proper treatment of the patient. Patients within hospital beds need to be able to contact the caregivers when they are in need of aid and would prefer to be in two-way communication with the caregivers during their time of need. Therefore, hospital beds include controls for actuating the mechanisms that adjust the bed and microphones and speakers for providing communication between the patient and the caregivers. Nurse call systems for communicating with the caregivers are known.

The controls and speakers are mounted in housings on the bed. These housing have openings formed therein to provide communication between switches operable by the patient and electrical circuitry actuated by those switches and to provide a speaker grill to provide a path for sound waves generated by the speaker. Each opening in the housing provides a possible path for dirt, cleaning fluid, and other fluids or contaminants to enter the housing and damage the speaker and the electrical components contained in the housing. The housing containing the speaker and electronic circuitry are often incorporated into bed siderails, but may also be incorporated into head or foot end rails or elsewhere on the bed.

Figure 1:
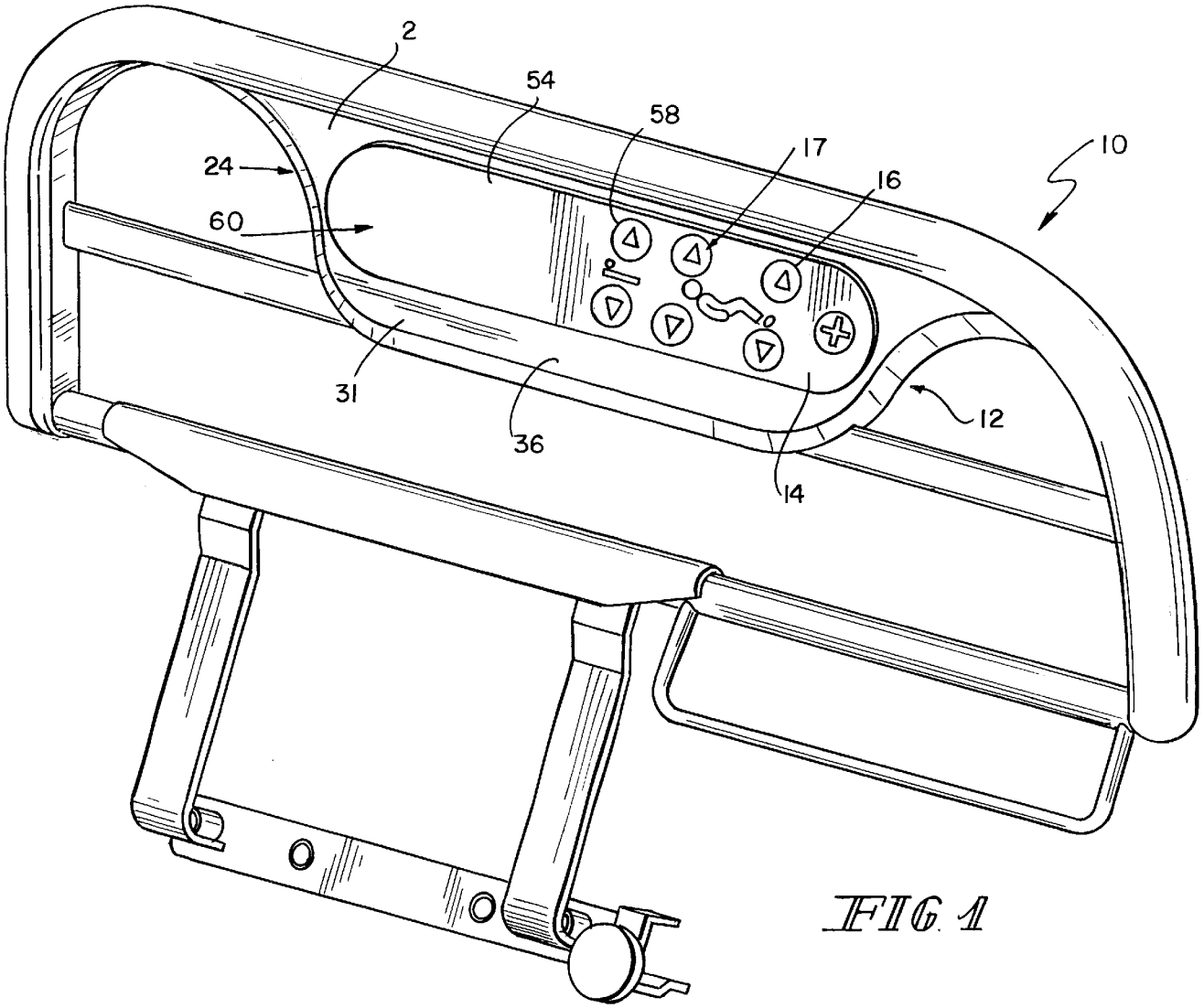
FIG. 1 is a perspective view of the caregiver-facing side of a hospital bed siderail containing a speaker and electronic circuitry enclosed within a housing and a waterproof cover extending across caregiver-operable pressure sensitive switches to prevent dirt and fluids from entering the housing, the waterproof cover including indicia indicating the location of the switches thereunder.
Figure 2:
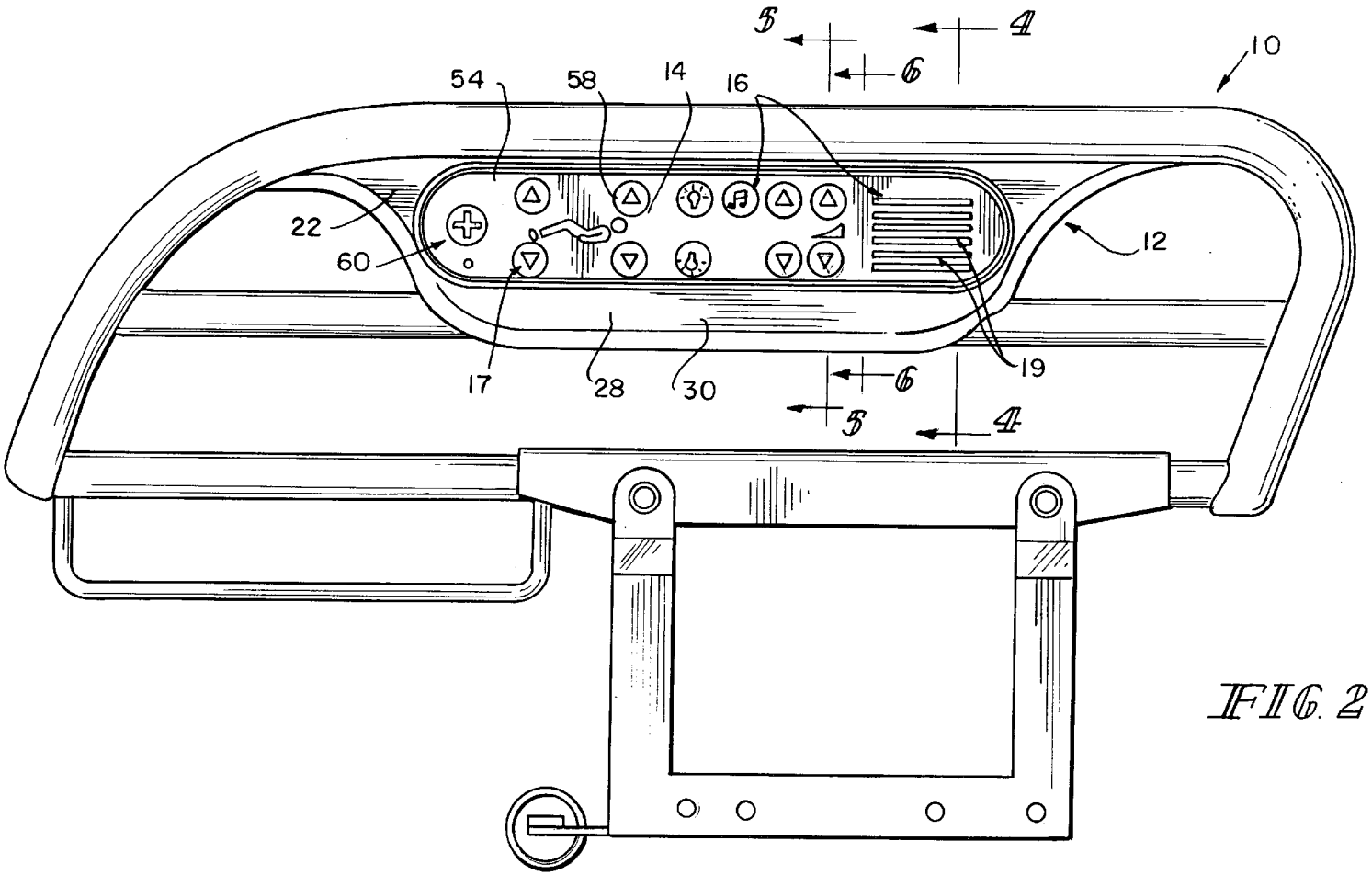
FIG. 2 is a plan view of the patient-facing side of the bed siderail of FIG. 1 showing a waterproof cover extending across patient-operable pressure sensitive switches to prevent dirt and fluids from entering the housing, the waterproof cover including indicia indicating the location of the switches thereunder and decorative lines simulating a speaker grill to indicate the location of the speaker in the housing.
Figure 3:
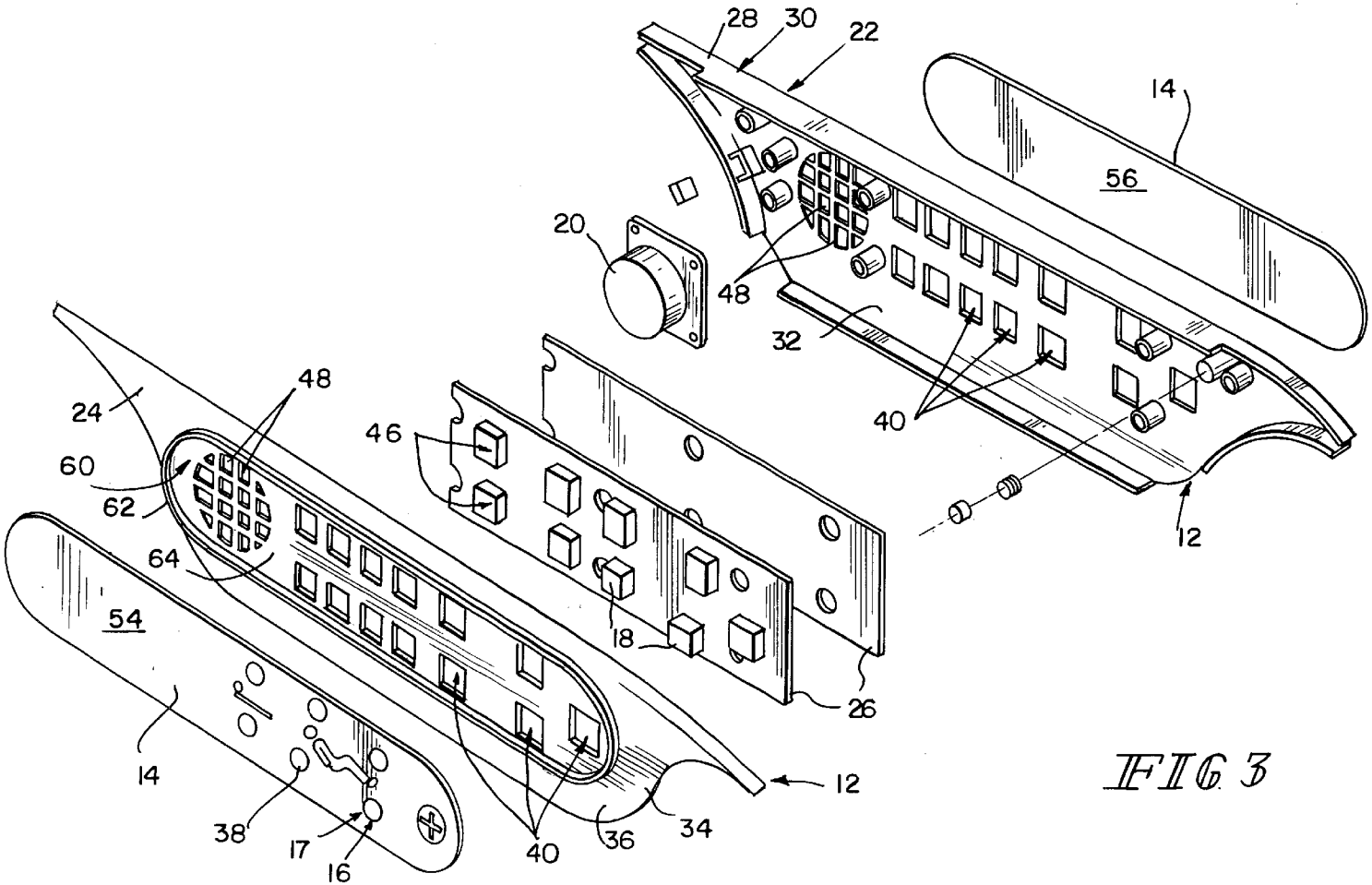
FIG. 3 is an exploded perspective view of the housing of the bed siderail of FIG. 1 showing the speaker contained in the housing, circuit boards having a plurality of push-button switches, two housing shells with openings therethrough to provide access to the switches and form a speaker grill, and the waterproof covers for covering grill openings and switch access openings to prevent dirt and fluid from entering the housing.

The illustrated embodiment of the present invention provides a protective cover over the openings in the housing to reduce the likelihood that dirt, fluid, or other contaminants will enter an interior region of the housing and damage the speaker or electronic circuitry located within the interior region. Referring now to FIGS. 1–2, a bed siderail 10 is provided for attachment to a hospital bed (not shown). Siderail 10 includes a housing 12 and a pair of waterproof covers 14 attached to the housing 12. While the drawings illustrate only one siderail 10, it is to be understood that most hospital beds have two or more siderails 10 located on opposite sides of the bed. As shown in FIG. 3, waterproof cover 14 includes indicia 16 thereon indicating the function of underlying switches 18 and components, including a speaker 20, contained in the housing 12 as will be described hereinafter. It is understood that while the drawings refer to switches 18 and speakers 20 enclosed in a housing 12 connected to a siderail 10 of a hospital bed, the invention disclosed herein is not limited to use with bed siderails 10 but may also be used in head rails and foot rails of hospital beds, or in other housing on the bed.

The indicia 16 on the waterproof cover 14 includes switch location indicia 17 which indicates the location of switches 18 underlying waterproof cover 14 that actuate various control systems. Switch location indicia 17 on the illustrated covers 14 symbolically indicate that the covers 14 are for use with beds which include a nurse call button, bed articulation control systems, bed hi/lo control, controls for room lighting, controls for music, controls for a television located in the patient's room, controls for the volume of the speaker 20, or other buttons that control any other function of the bed or the surrounding environment.

Figure 4:
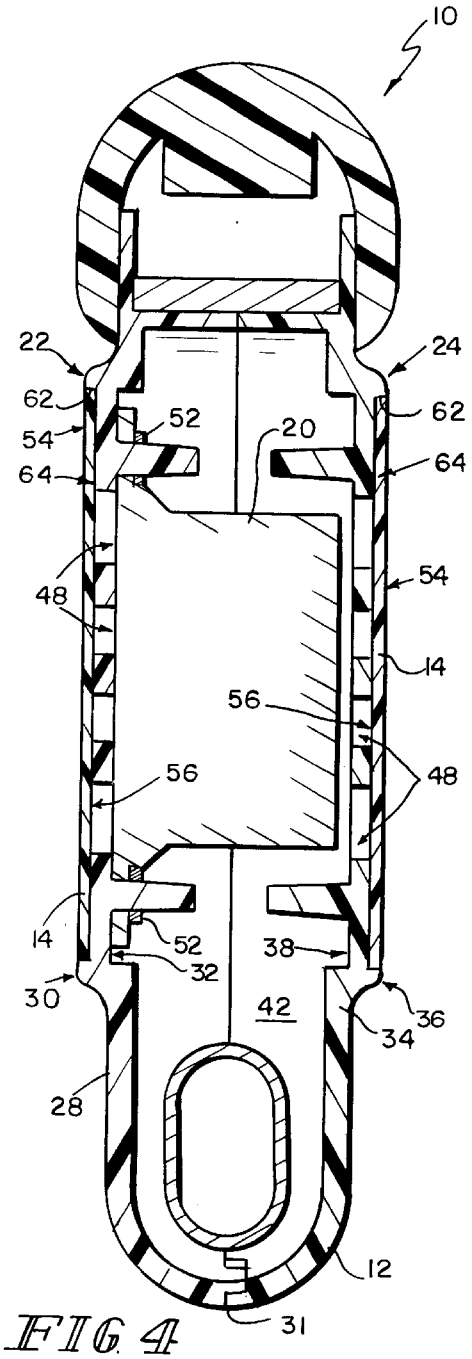
FIG. 4 is a cross-sectional view taken along line 4—4 of FIG. 2 showing the speaker enclosed in the housing, the openings forming the speaker grill through the shells of the housing, and the waterproof covers disposed over the speaker grill openings to prevent dirt and fluid from entering an interior region of the housing.
Figure 6:
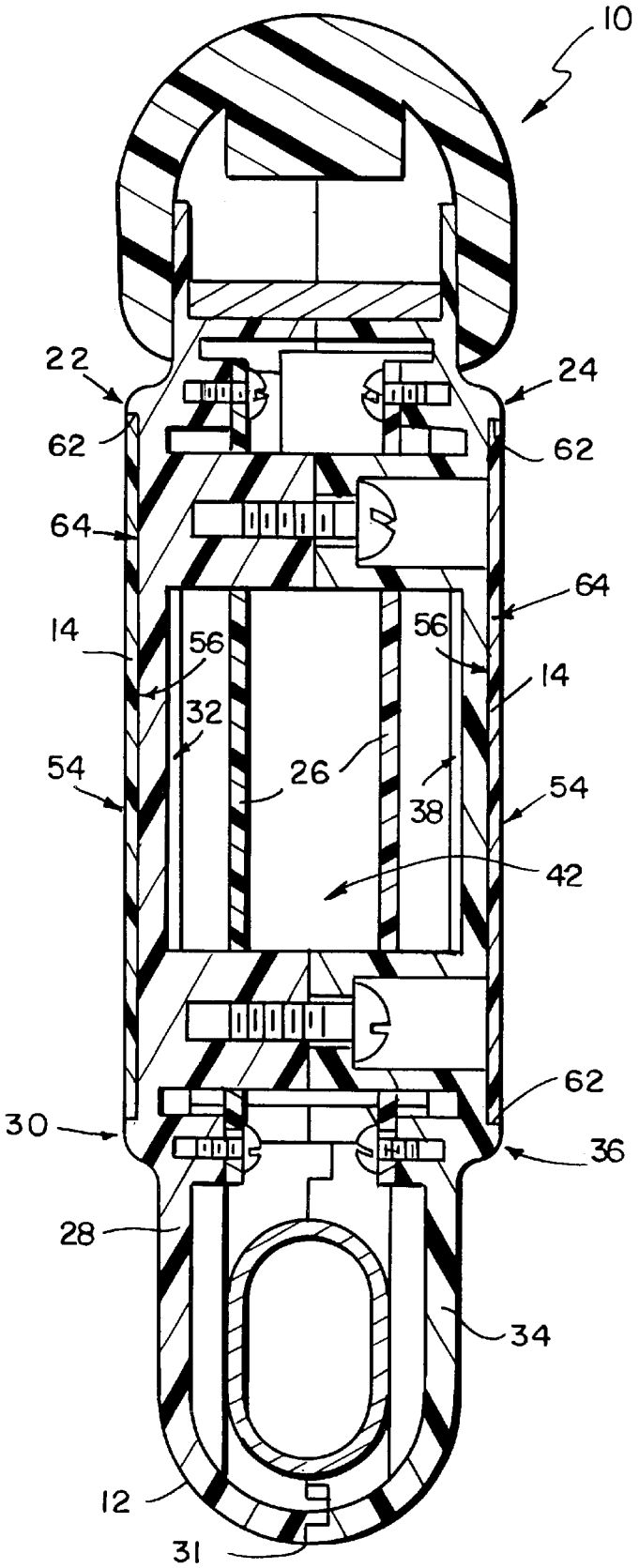
FIG. 6 is a cross-sectional view taken along line 6—6 of FIG. 2.

The bed siderail 10 includes a patient-facing side 22 and an oppositely directed caregiver-facing side 24. Certain functions controlled by the switches 18 are operable by either the patient or the caregiver. In the illustrated embodiment, switches 18 for controlling bed positioning and the nurse call system are operable from either the patient-facing side 22 or the caregiver-facing side 24 of housing 12. The graphical information on the waterproof cover and the switch location indicia 17 indicate that deck articulation and nurse call functions are operable from either patient-facing side 22 or caregiver-facing side 24, as shown, for example, in FIGS. 1 and 2. Caregiver-facing side 24 also includes a hi/lo control for the bed which is not operable from patient-facing side 22, while patient-facing side 22 includes room lighting, music, television station, and volume controls which are not operable from caregiver facing side 24. Therefore, as shown, for example, in FIGS. 4 and 6, circuit boards 26 including switches 18 are disposed in the housing 12 so that switches 18 controlling certain functions are accessible from both the patient-facing 22 and caregiver-facing 24 side of the bed siderail 10 and other switches are only accessible from one or the other sides of bed siderail 10.

Housing 12 includes a patient-facing shell 28 having an external surface 30 and an internal surface 32 and a symmetrically formed caregiver-facing shell 34 having an external surface 36 and an internal surface 38. The illustrated patient-facing shell 28 and caregiver-facing shell 34 are molded from polypropylene but may be manufactured using other appropriate techniques and materials so long as the shells may be joined to form a water resistant seam 31 at the point of connection of the shells 28, 34.

Each external surface 30, 36 of patient-facing shell 28 and caregiver-facing shell 34 is formed to include a recessed area 60 having a side wall 62 and a bottom wall 64. Patient-facing shell 28 and caregiver-facing shell 34 are formed to include switch access openings 40 providing communication with an interior region 42 of the housing 12 through external surfaces 30, 36. Switch access openings 40 pass through bottom wall 64 of recessed area 60. Each switch access opening 40 is sized to receive an actuator surface 46 of a switch 18. Circuit boards 26 are attached by fasteners 51 to patient facing shell 28 and caregiver-facing shell 34 so that switches 18 are disposed in the switch access openings 40 with the actuator surfaces 46 of switches 18 being substantially flush with bottom wall 64 of recessed area 60 of external surfaces 30, 36 of shells 28, 34, respectively, as shown, for example, in FIG. 5.

Patient-facing shell 28 and caregiver-facing shell 34 are also formed to include speaker grill openings 48 extending through the bottom wall 64 of the recessed area 60 to facilitate passage of sound waves generated by speaker 20 from the interior region 42 of the housing 12 through shells 28, 34. Speaker 20 is disposed within the interior region 42 of housing 12 adjacent speaker grill openings 48 and is attached to the internal surface 32 of patient-facing shell 28 by fasteners 52 as shown, for example in FIG. 4. Sound waves generated by speaker 20 pass through speaker grill openings 48 and vibrate as well as pass through the waterproof cover 14, thereby allowing the sound waves to be audible to the patient. It is understood that the grill openings 48 may have any desired shape. See, for example, FIGS. 10–15, which show alternative grill opening 48 configurations.

In the illustrated embodiment, waterproof cover 14 is located over each switch access opening 40 and speaker grill opening 48 in housing 12. Waterproof cover 14 has substantially the same configuration as recessed area 60 and is received in recessed area 60 so that the exterior surface 54 of waterproof cover does not extend beyond external wall 30, 36 of patient-facing housing 28 and caregiver-facing housing 34.

Certain switches 18, such as those actuating the nurse call system and the bed adjustment systems, incorporated into the illustrated embodiment are illuminated push button switches, such as Rafi SPST PCB mounted keyswitches Part Nos. 3.14100.988, 3.14200.011-3.14200.013. The remaining switches 18 may also be illuminated switches, or may be non-illuminated switches such as Rafi SPST PCB mounted keyswitches Part Nos. 3.14100.001 or 3.14100.006. Switches 18 are activated by pushing on the appropriate location of the waterproof cover 14 overlying the switch access openings 40 and the switch actuator surface 46. Since the switches 18 are covered by the waterproof cover 14, waterproof cover 14 includes switch location indicia 17 indicating the location of the switches 18 thereunder and the functions of the bed which those switches operate. The lights in illuminated switches 18 provide backlighting for the switch location indicia 17 by shining through waterproof cover 14 aiding the patient in locating the switches 18 in darkness. In order to provide illumination of the switches 18, the illustrated waterproof cover 14 is translucent in the area of the switch location indicia 17. It is understood that covers 14 may also be used over switches without back lighting.

Figure 5:
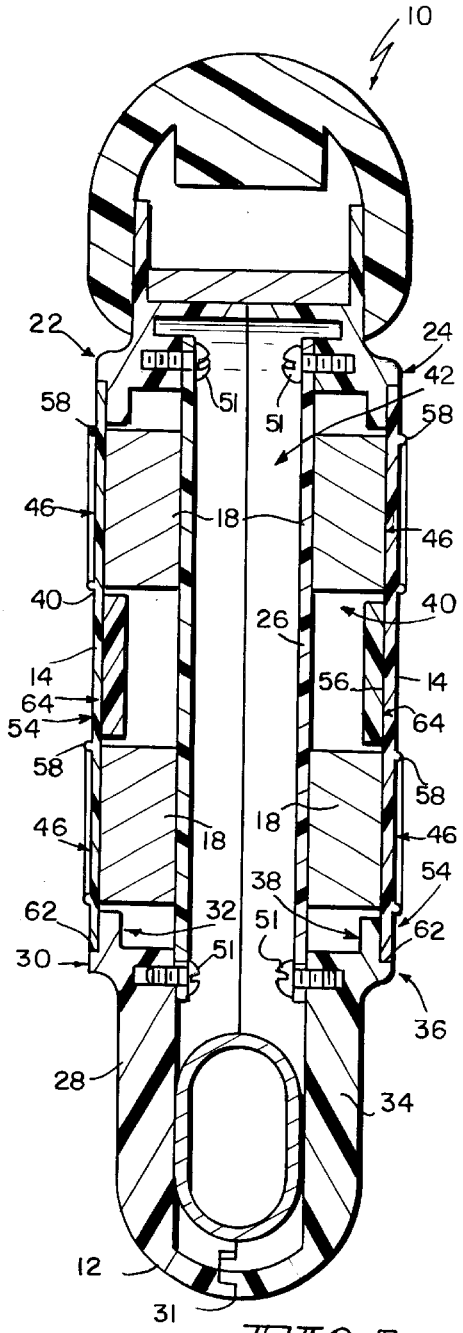
FIG. 5 is a cross-sectional view taken along line 5—5 of FIG. 2 showing the circuit boards containing oppositely facing pressure sensitive switches enclosed in the housing, the switch access openings in the housing within which the switch actuating surfaces are located, and the waterproof cover disposed over the switch access openings to prevent dirt and fluid from entering the housing.
Figures 7, 8, 9:
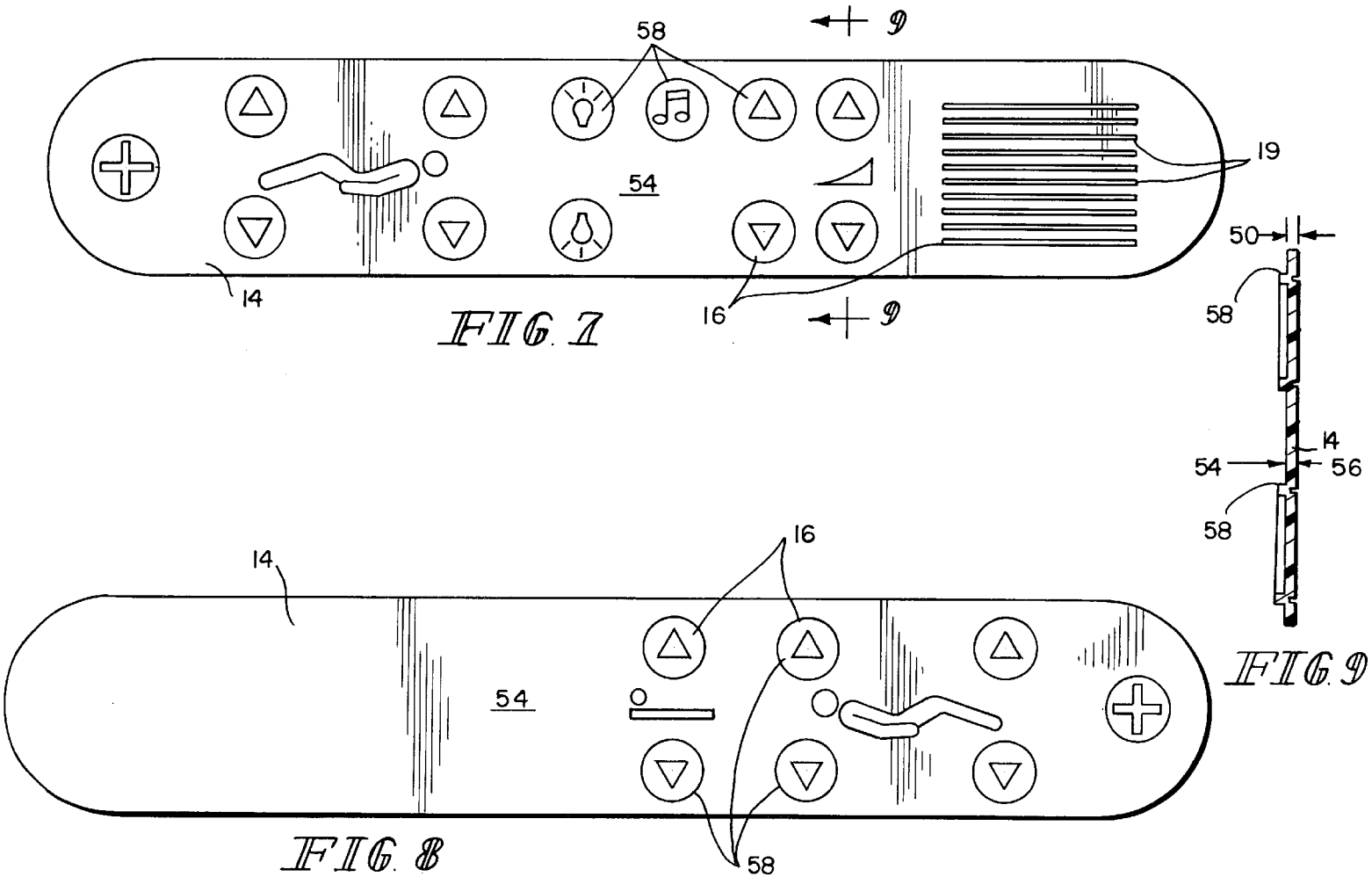
FIG. 7 is a plan view of a patient-facing waterproof cover similar to the cover shown in FIG. 1 showing switch location indicators and simulated speaker grill lines.
FIG. 8 is a plan view of a caregiver-facing waterproof cover similar to the cover shown in FIG. 2.
FIG. 9 is as cross sectional view taken along line 9—9 of FIG. 7 showing a raised embossed area surrounding the switch location indicators; and, FIGS. 10–15 show patterns for alternative speaker grill configurations and adhesive application patterns for the portion of waterproof speaker cover that extends over the speaker openings.
Figure 10:
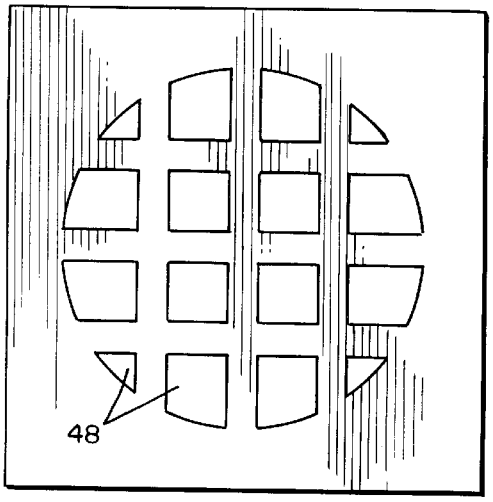
Figure 11:
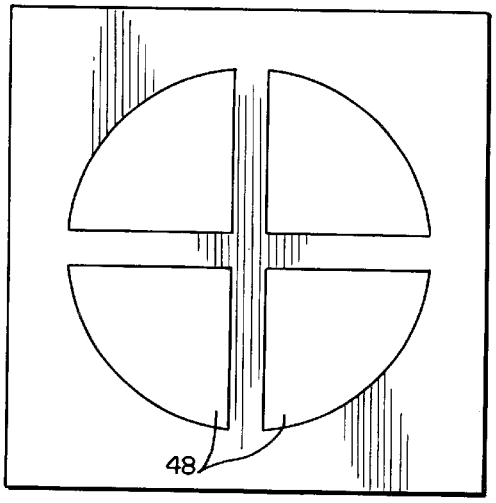
Figure 12:
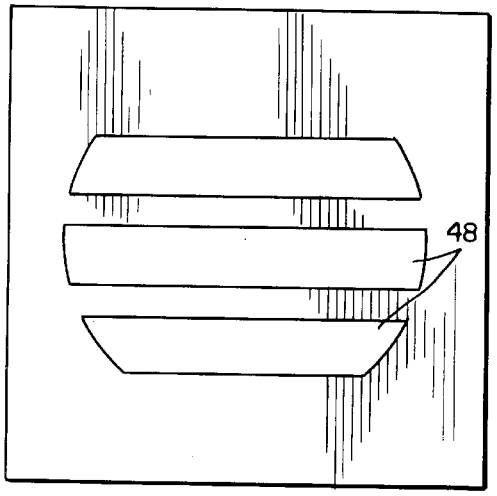
Figure 13:
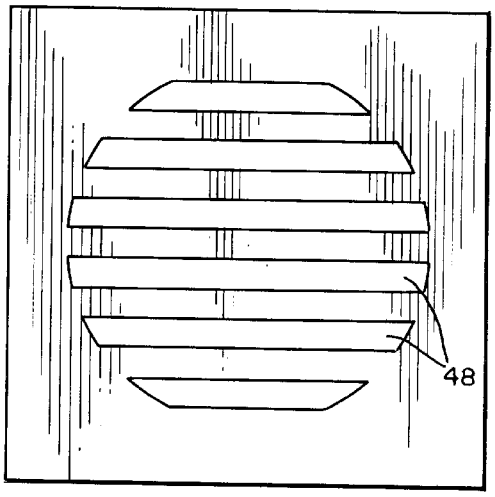
Figure 14:
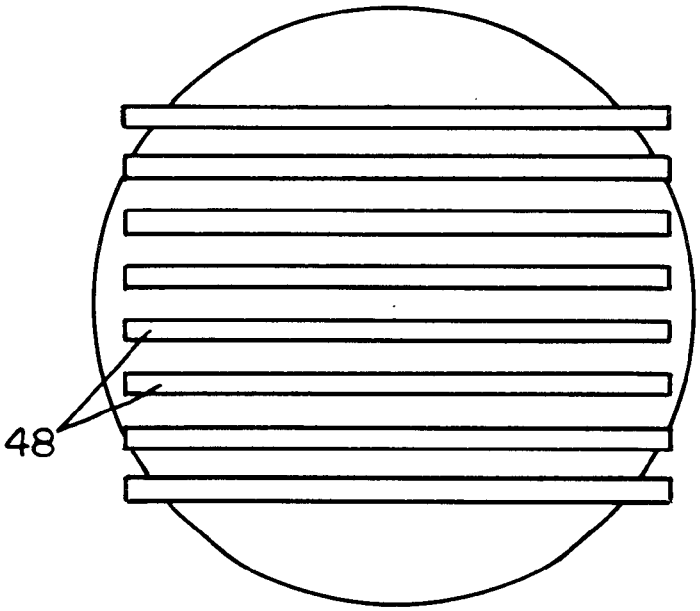
Figure 15:
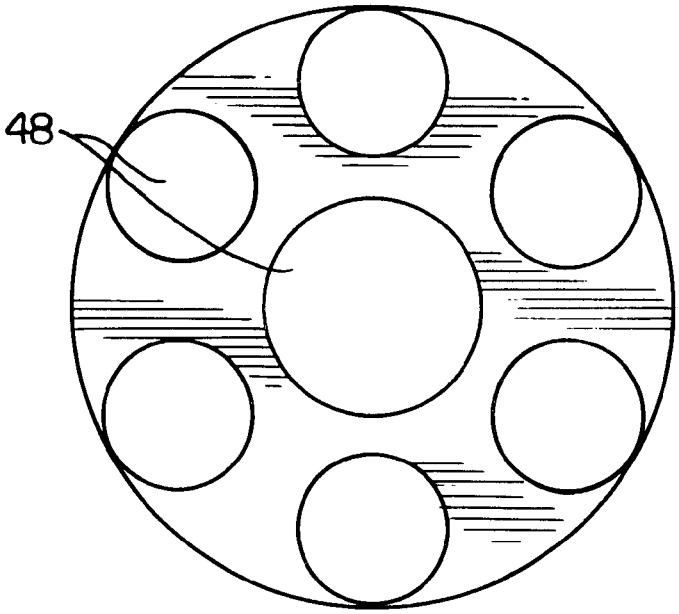

In the illustrated embodiment, waterproof cover 14 includes raised areas 58 embossed in waterproof cover 14 to form a ring surrounding switch location indicia 17, as shown, for example, in FIGS. 5 and 9. As shown in FIG. 5, the raised rings 58 surrounding the switch location indicia are sized to be smaller than the surface area of the underlying switch actuator surface 46 so that if a user pushes on the waterproof cover within the interior of the ring 58, the switch 18 is actuated.

Waterproof cover 14 also includes parallel lines 19 shown in FIGS. 2 and 7 which give the impression of a speaker grill to indicate to the patient the location of the underlying speaker 20. These speaker lines 19, of course, do not penetrate through the waterproof cover 14 and are merely surface ornamentation. Therefore, the waterproof cover 14 inhibits moisture and dirt entry into the housing 12.

In the illustrated embodiment, housing 12 is formed from plastic shells 28, 34 which may be screwed, snapped, glued, welded or otherwise appropriately joined together to form a water resistant connection 31 between the shells 28, 34. The illustrated waterproof cover 14 is made from polyester or the like. Waterproof cover 14 is attached to housing 12 with an appropriate adhesive, such as 3M adhesive 9672LE, so that switch location indicia 17 overlays the actuator surfaces 46 of switches 18 and grill lines 19 overlay speaker 20 and speaker grill openings 48. Waterproof cover 14 includes an exterior surface 54 and an attachment surface 56 as best shown in FIG. 9. Adhesive is applied to attachment surface 56 in all locations except those locations which are adjacent to the speaker grill openings 48 and the switch access openings 40.

Exterior surface 54 and attachment surface 56 are displaced from one another and together define a thickness 50 of the waterproof cover 14. In the illustrated embodiment waterproof cover 14 has a thickness 50 of about 5 mils (0.005"). It has been found that waterproof covers 14 having thicknesses 50 between about 3 and about 5 mils prevent moisture entry into the interior region 42 of the housing 12, are sufficiently durable to withstand multiple washings, are sufficiently translucent to allow illuminated switches 18 to back light the switch location indicia 17, and do not excessively distort or muffle the sounds generated by the speaker 20. It is to be understood that depending on the properties of the materials used to form waterproof cover, other thicknesses 50 of material may be used as long as such material allows sound waves to pass or be transmitted through waterproof cover 14.

While in the illustrated embodiment speaker 20 and switches 18 are contained in a single housing 12 attached to a bed rail 10 which is attached to a hospital bed, it should be understood that speaker and switches need not be enclosed in the same housing.

Although the invention has been described in detail with reference to a certain illustrated embodiment, variations and modifications exist within the scope and spirit of the invention as described and defined in the following claims.

What is claimed is:

1. An apparatus for use on a hospital bed, the apparatus comprising:

a housing configured to be coupled to a portion of the hospital bed, the housing having a surface defining an interior region, the surface being formed to include an opening in communication with the interior region;

a speaker located in the interior region of the housing adjacent to the opening, the speaker being configured to generate sound waves; and a waterproof cover permanently attached to the surface of the housing, the cover being configured to seal the opening against water penetration through the opening and into the interior region of the housing, the cover being configured so that the sound waves are audible through the cover.

2. The apparatus of claim 1, wherein the waterproof cover is attached to the surface of the housing with an adhesive.

3. The apparatus of claim 2, wherein the housing is formed to include a plurality of openings, the speaker is located adjacent to the plurality of openings, and the waterproof cover seals all of the plurality of openings against water penetration.

4. The apparatus of claim 2, wherein the waterproof cover is made from a polyester material.

5. The apparatus of claim 4, wherein the waterproof cover has a thickness of about 0.003 to about 0.005 inches.

6. The apparatus of claim 1, wherein the waterproof cover includes a speaker location indicia located adjacent the opening in the surface of the housing.

7. The apparatus of claim 6, wherein the waterproof cover has a thickness of about 0.003 to about 0.005 inches.

8. The apparatus of claim 1, further comprising a system controlled by a switch having an actuating surface, the housing being formed to include a switch access opening, the switch being located in the interior region of the housing with the actuator surface positioned in the switch access opening, and the waterproof cover being attached to surface of the housing to seal the switch access opening against water penetration.

9. The apparatus of claim 8, wherein the switch is an illuminated switch generating light and waterproof cover is translucent in the vicinity of the switch so that light generated by the switch is partially transmitted though the waterproof cover.

10. The apparatus of claim 8, wherein the system controlled by the switch is one of a nurse call system, a bed articulation control, a bed hi/lo control, a room lighting control, music control, and a television control.

11. The apparatus of claim 1, wherein the housing surface is formed to include a lip surrounding an outer perimeter edge of the cover.

12. The apparatus of claim 1, wherein the housing coupled to a siderail of the hospital bed.

13. The apparatus of claim 12, wherein the housing includes a first shell portion and a second shell portion configured to be coupled to the first shell portion to define the housing.

14. The apparatus of claim 13, wherein the first and second shell portions are formed from a molded plastic material.

15. The apparatus of claim 12, wherein the housing includes a patient-facing side surface and a caregiver-facing side surface, the patient-facing side surface and the caregiver-facing side surface each being formed to include and opening to facilitate passage of sound waves from the speaker therethrough, the apparatus including first and second waterproof covers attached to the patient-facing side surface and the caregiver-facing side surface, respectively, to seal the openings against water penetration into the interior region of the housing.

16. An apparatus for use on a hospital bed, the apparatus comprising:

a housing configured to be coupled to a portion of the hospital bed, the housing having an interior region and a surface formed to include an opening in communication with the interior region, the opening being defined by an outer perimeter edge;

a speaker located in the interior region of the housing adjacent the opening, the speaker being configured to generate sound waves; and a generally planar waterproof cover coupled to the surface of the housing to seal the entire outer perimeter edge of the opening to prevent water penetration through the opening and into the interior region of the housing, the cover being configured so that the sound waves are audible through the cover.

17. The apparatus of claim 16, wherein the waterproof cover is attached to the surface of the housing with an adhesive.

18. The apparatus of claim 17, wherein the housing is formed to include a plurality of openings, the speaker is located adjacent to the plurality of openings, and the waterproof cover seals all of the plurality of openings against water penetration.

19. The apparatus of claim 17, wherein the waterproof cover is made from a polyester material.

20. The apparatus of claim 19, wherein the waterproof cover has a thickness of about 0.003 to about 0.005 inches.

21. The apparatus of claim 16, wherein the waterproof cover includes a speaker location indicia located adjacent the opening in the surface of the housing.

22. The apparatus of claim 21, wherein the waterproof cover has a thickness of about 0.003 to about 0.005 inches.

23. The apparatus of claim 16, further comprising a system controlled by a switch having an actuating surface, the housing being formed to include a switch access opening, the switch being located in the interior region of the housing with the actuator surface positioned in the switch access opening, and the waterproof cover being attached to the surface of the housing to seal the switch access opening against water penetration.

24. The apparatus of claim 23, wherein the switch is an illuminated switch generating light and the waterproof cover is translucent in the vicinity of the switch so that light generated by the switch is partially transmitted through the waterproof cover.

25. The apparatus of claim 23, wherein the system controlled by the switch is one of a nurse call system, a bed articulation control, a bed hi/lo control, a room lighting control, music control, and a television control.

26. The apparatus of claim 16, wherein the housing surface is formed to include a lip surrounding an outer perimeter edge of the cover.

27. The apparatus of claim 16, wherein the housing is coupled to a siderail of the hospital bed.

28. The apparatus of claim 27, wherein the housing includes a first shell portion and a second portion configured to be coupled to the first shell portion to define the housing.

29. The apparatus of claim 28, wherein the first and second shell portions are formed from a molded plastic material.

30. The apparatus of claim 27, wherein the housing includes a patient-facing side surface and a caregiver-facing side surface, the patient-facing side surface and the caregiver-side surface each being formed to include an opening to facilitate passage of sound waves from the speaker therethrough, the apparatus including first and second waterproof covers attached to the patient-facing side surface and the caregiver-facing side surface, respectively, to seal the openings against water penetration into the interior region of the housing.

31. An apparatus for use in a hospital bed, the apparatus comprising:

a housing configured to be coupled to a portion of the hospital bed, the housing including an exterior surface having a recess therein and an interior surface, the exterior surface and the interior surface defining an opening therebetween located within the recess;

a speaker located inside the housing adjacent to the opening, the speaker being configured to generate sound waves; and a waterproof cover located in the recess and coupled to the exterior surface to seal the opening against water penetration, the cover being configured so that the sound waves are audible through the cover.

32. The apparatus of claim 31, wherein the waterproof cover is attached to the surface of the housing with an adhesive.

33. The apparatus of claim 32, wherein the housing is formed to include a plurality of openings, the speaker is located adjacent to the plurality of openings, and the waterproof cover seals all of the plurality of openings against water penetration.

34. The apparatus of claim 32, wherein the waterproof cover is made from a polyester material.

35. The apparatus of claim 34, wherein the waterproof cover has a thickness of about 0.003 to 0.005 inches.

36. The apparatus of claim 31, wherein the waterproof cover includes a speaker location indicia located adjacent the opening in the surface of the housing.

37. The apparatus of claim 36, wherein the waterproof cover has a thickness of about 0.003 to about 0.005 inches.

38. The apparatus of claim 31, further comprising a system controlled by a switch having an actuating surface, the housing being formed to include a switch access opening, the switch being located in the interior region of the housing with the actuator surface positioned in the switch access opening, and the waterproof cover being attached to surface of the housing to seal the switch access opening against water penetration.

39. The apparatus of claim 38, wherein the switch is an illuminated switch generating light and waterproof cover is translucent in the vicinity of the switch so that light generated by the switch is partially transmitted through the waterproof cover.

40. The apparatus of claim 38, wherein the system controlled by the switch is one of a nurse call system, a bed articulation control, a bed hi/lo control, a room lighting control, a music control, and a television control.

41. The apparatus of claim 31, wherein the housing surface is formed to include a lip surrounding an outer perimeter edge of the cover.

42. The apparatus of claim 31, wherein the housing is coupled to a siderail of the hospital bed.

43. The apparatus of claim 42, wherein the housing includes a first shell portion and a second shell portion configured to be coupled to the first shell portion to define the housing.

44. The apparatus of claim 43, wherein the first and second shell portions are formed from a molded plastic material.

45. The apparatus of claim 42, wherein the housing includes a patient-facing side surface and a caregiver-facing side surface, patient-facing side surface and the caregiver-facing side surface each being formed to include an opening to facilitate passage of sound waves from the speaker therethrough, the apparatus including first and second waterproof covers attached to the patient-facing side surface and the caregiver-facing side surface, respectively, to seal the openings against water penetration into the interior region of the housing.

46. The apparatus of claim 31, wherein the cover is substantially planar, the cover being substantially coplanar with the exterior surface when the cover is located in the recess.

47. The apparatus of claim 46, wherein a thickness of the cover is substantially equal to a depth of the recess.

48. The apparatus of claim 31, wherein the opening is defined by an outer perimeter edge and the cover is sealed to the surface around the entire outer perimeter edge of the opening.

49. An apparatus for use on a hospital bed, the apparatus comprising:

a siderail coupled to the hospital bed, the siderail having a surface defining an interior region, the surface being formed to include an opening in communication with the interior region;

a speaker located in the interior region of the siderail adjacent to the opening, the speaker being configured to generate sound waves; and a waterproof cover permanently attached to the surface of the siderail, the cover being configured to seal the opening against water penetration through the opening and into the interior region of the siderail, the cover being configured so that the sound waves are audible through the cover.

50. The apparatus of claim 49, wherein the waterproof cover is attached to the surface of the siderail with an adhesive.

51. The apparatus of claim 50, wherein the siderail is formed to include a plurality of openings, the speaker is located adjacent to the plurality of openings, and the waterproof cover seals all of the plurality of openings against water penetration.

52. The apparatus of claim 49, wherein the waterproof cover is made from a polyester material.

53. The apparatus of claim 49, wherein the waterproof cover has a thickness of about 0.003 to about 0.005 inches.

54. The apparatus of claim 49, wherein the waterproof cover includes a speaker location indicia located adjacent the opening in the surface of the siderail.

55. The apparatus of claim 49, further comprising a system controlled by a switch having an actuating surface, the siderail being formed to include a switch access opening, the switch being located in the interior region of the siderail with the actuator surface positioned in the switch access opening, and the waterproof cover being attached to surface of the siderail to seal the switch access opening against water penetration.

56. The apparatus of claim 55, wherein the switch is an illuminated switch generating light and waterproof cover is translucent in the vicinity of the switch so that light generated by the switch is partially transmitted though the waterproof cover.

57. The apparatus of claim 55, wherein the system controlled by the switch is one of a nurse call system, a bed articulation control, a bed hi/lo control, a room lighting control, music control, and a television control.

58. The apparatus of claim 49, wherein the siderail surface is formed to include a lip surrounding an outer perimeter edge of the cover.

59. The apparatus of claim 49, wherein the siderail includes a first shell portion and a second shell portion configured to be coupled to the first shell portion to define the siderail.

60. The apparatus of claim 49, wherein the siderail includes a patient-facing side surface and a caregiver-facing side surface, the patient-facing side surface and the caregiver-facing side surface each being formed to include an opening to facilitate passage of sound waves from the speaker therethrough, the apparatus including first and second waterproof covers attached to the patient-facing side surface and the caregiver-facing side surface, respectively, to seal the openings against water penetration into the interior region of the housing.

* * * * *